US009079759B2

(12) United States Patent
Walker et al.

(10) Patent No.: US 9,079,759 B2
(45) Date of Patent: Jul. 14, 2015

(54) ILLUMINATED TAP HANDLE

(75) Inventors: Andrew S. Walker, Vero Beach, FL (US); James R. Lester, Lambton Shores (CA); Brian D. G. Maxfield, Camlachie (CA)

(73) Assignee: ILLUMITAP LLC, Boynton Beach, FL (US)

( * ) Notice: Subject to any disclaimer, the term of this patent is extended or adjusted under 35 U.S.C. 154(b) by 542 days.

(21) Appl. No.: 13/403,185

(22) Filed: Feb. 23, 2012

(65) Prior Publication Data

US 2013/0176709 A1 Jul. 11, 2013

Related U.S. Application Data

(60) Provisional application No. 61/585,471, filed on Jan. 11, 2012.

(51) Int. Cl.

| | |
|---|---|
| ***E05B 17/10*** | (2006.01) |
| ***B67D 1/08*** | (2006.01) |
| *B67D 7/14* | (2010.01) |
| *F21Y 101/02* | (2006.01) |

(52) U.S. Cl.

CPC ..... *B67D 1/0874* (2013.01); *B67D 7/145* (2013.01); *F21Y 2101/02* (2013.01)

(58) Field of Classification Search

CPC ..... A46B 15/0036; A46B 2200/1066; A46B 15/0044; B60Q 3/0233; B67D 7/145; B67D 1/0874; F21Y 2101/02

USPC ..... 15/105, 167.1, 22.1, 247; 362/501, 509, 362/100, 109, 511, 544, 546, 96, 183, 802; 600/249; 16/412; 239/71, 336.3; 200/310; 222/113, 52; 40/332

See application file for complete search history.

(56) References Cited

U.S. PATENT DOCUMENTS

| | | | | |
|---|---|---|---|---|
| 3,321,861 | A * | 5/1967 | Tate, Jr. | 40/332 |
| 4,225,057 | A * | 9/1980 | Horn | 222/27 |
| 7,096,617 | B2 * | 8/2006 | Bydalek et al. | 40/332 |

* cited by examiner

*Primary Examiner* — Stephen F Husar
*Assistant Examiner* — Danielle Allen

(57) ABSTRACT

An illuminated tap handle comprises a handle casing, a LED light strip, a battery, a charging station, and a remote control. The LED light strip comprises a plurality of LED lights. The plurality of LED lights and the battery are hermetically sealed within the handle casing to prevent damage from corrosive materials and electronically connected to each other. The handle casing design can be easily altered to meet the needs of the consumer. The LED light strip and the battery can be installed in any casing design to better promote the branding. The remote control controls the effects of the plurality of LED lights. An induction charging method is used to charge the illuminated tap handle to prevent any kind of damages that may happen during the charging process. The illuminated tap handle is easily connected to the existing beer towers with a simple screwing mechanism.

17 Claims, 11 Drawing Sheets

SECTION B-B
SCALE 1 : 3

SECTION B-B
SCALE 1 : 3

ILLUMINATED TAP HANDLE

The current application claims a priority to the U.S. Provisional Patent application Ser. No. 61/585,471 filed on Jan. 11, 2012.

FIELD OF THE INVENTION

The present invention relates generally to an apparatus for a handle. More specifically, the apparatus is an illuminated tap handle that comprises a charging station and a remote control.

BACKGROUND OF THE INVENTION

Beer tap handles have been used by a wide variety of people for centuries to dispense beer. The beer handles have evolved into many different shapes and forms throughout the years. Different types of beer tap handles often display different designs for promotional purposes. Currently, there are no beer tap handle's that utilize a remote operation. It is therefore an object of the present invention to introduce an illuminated tap handle that comprises a charging station and a remote control to allow a user to have complete control over desired lighting effects.

DETAIL DESCRIPTIONS OF THE INVENTION

Figure 1:
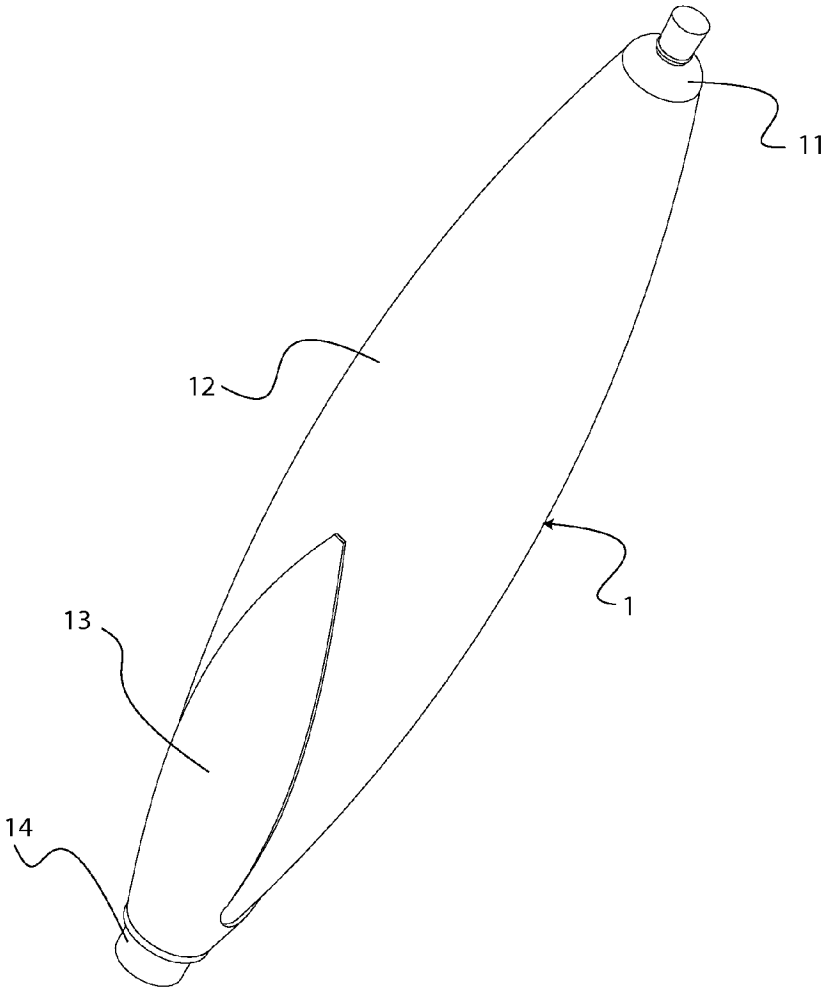
FIG. 1 is a perspective view of a handle component of the present invention.
Figure 2:
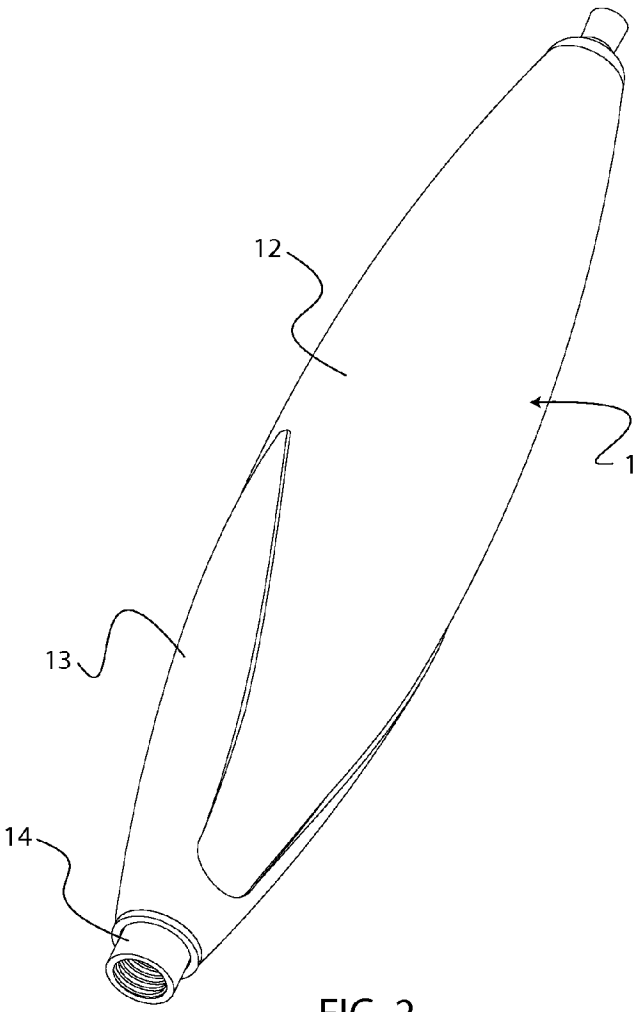
FIG. 2 is a bottom perspective view of the handle component of the present invention.
Figure 4:
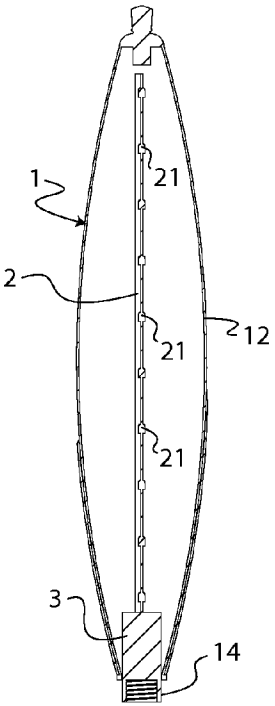
FIG. 4 is a cross-section view of the FIG. 3
Figure 3:
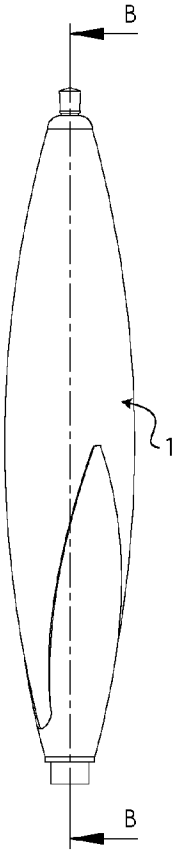
FIG. 3 is a side view of the present invention.

All illustrations of the drawings are for the purpose of describing selected versions of the present invention and are not intended to limit the scope of the present invention.

The present invention is an illuminated tap handle that comprises a handle casing 1, a LED light strip 2, a battery 3, a charging station 4, and a remote control 5. The handle casing 1 comprises a top connector 11, a transparent face 12, a holder 13 and a bottom connector 14. The top connector 11 is connected to the transparent face 12 from above. The transparent face 12 is inserted into the holder 13 and connected to the holder 13. The holder 13 is connected to the bottom connector

14. The transparent face 12 is made out of transparent materials such as clear plastic. The top connector 11, the holder 13 and the bottom connector 14 is made out of stainless steel. Stainless steel is used mainly because of its corrosion free material property and stainless steel also provides an aesthetically pleasing finished look for the components. The design of the branded casing can be manipulated to meet the desired needs of the beer companies to meet their branding requirements.

The remote control 5 allows the user to have complete control over desired lighting effects in the present invention. In order to attract more consumers, the users (Bartenders, Owners, Managers, etc.) are given complete control over the lighting of the present invention through using the remote control 5. The remote control 5 comprises a plurality of buttons 51 which controls all of the functions related to the present invention. Each button in the plurality of buttons 51 is given a specific functionality to simplify the process. The plurality of buttons 51 allows the user to adjust the illumination (Dim or Brighten), control fade effects between colors, flash the colors for added lighting effect, transition between set colors and turn the handle on or off to preserve the battery 3 life. It is possible to create a version of the product that contains LED illumination without the remote control; this adaptation would limit the effective spectrum from the handle and is up to the discretion of the consumer.

The LED light strip 2 and the battery 3 are positioned inside the handle casing 1. The LED light strip 2 is positioned on top of the battery 3 and the LED light strip 2 is electronically connected to the battery 3. The LED light strip 2 is hermetically sealed with the handle casing 1 to prevent any kind of corrosion or liquid damage. Since the LED light strip 2 is hermetically sealed, the LED light strip 2 can stand up to the high demands and damages involved with a given working environment. The LED light strip 2 comprises a plurality of LED lights 21 which is positioned in a vertical line along the LED light strip 2. Red, green, blue and white LED lights are used in the plurality of LED lights 21. The plurality of LED lights 21 and the mentioned four different colors allow the user to have the complete control over the color spectrum. For example, if advertisements are displayed in the transparent face 12, the plurality of LED lights 21 illuminates in white color so the advertisements are clearly displayed. If the user decides to simply use one specific color to illuminate the present invention, the user is able to select that particular color and the input command is given by the remote control 5. Having the ability to change the color scheme with the present invention is a key improvement because it can be a great asset for personalized events which comprises specific color themes.

The battery 3 is positioned above the bottom connector 14 and connected to the bottom connector 14. Lithium ion battery 3 is used as the battery 3 which holds about eight to twelve hours of battery 3 life per cycle. The battery 3 is also hermetically sealed inside the handle casing 1 to prevent from any kind of corrosion or liquid damage. Since the battery 3 is hermetically sealed, the battery 3 can stand up to the high demands and damages involved with a given working environment. The battery 3 is the only power source for the LED light strip 2. The battery is changed through induction charging eliminating the need for contact points. This is an improvement over the prior art as contact points in the desired industry would easily damage due to high risk of liquid contaminations and heavy use.

Figure 5:
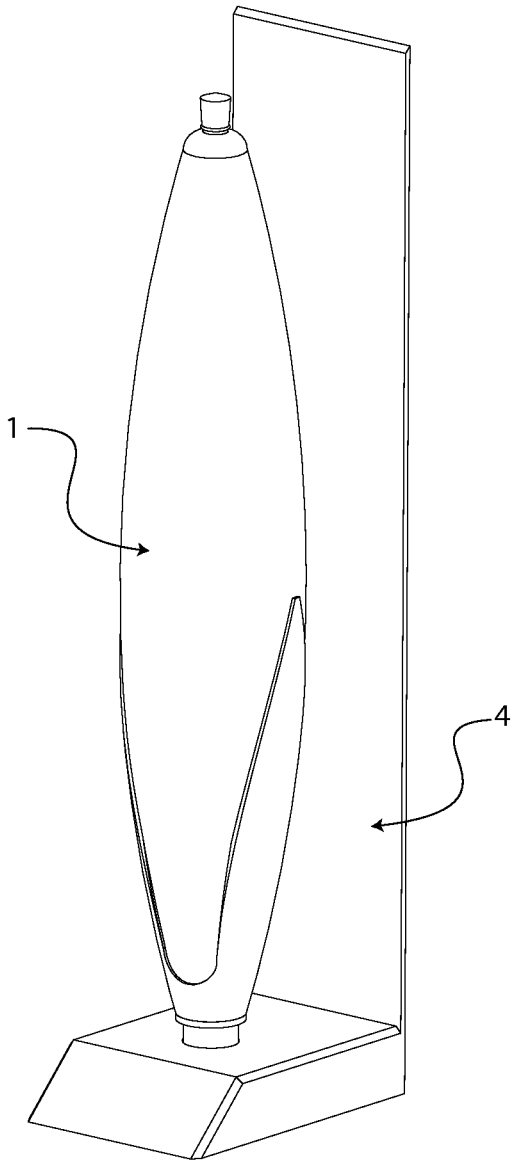
FIG. 5 is a perspective view of the handle component and a first embodiment charging component of the present invention.
Figure 6:
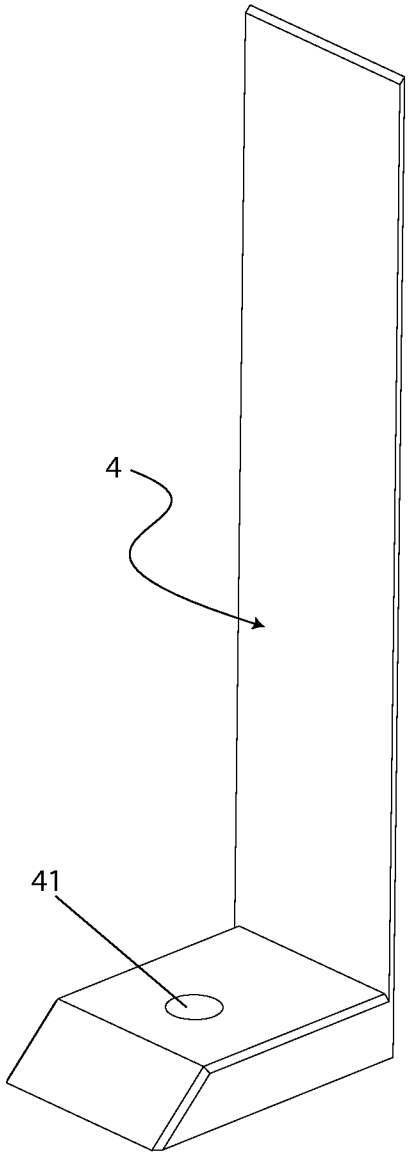
FIG. 6 is a perspective view of the first embodiment charging component of the present invention.
Figure 7:
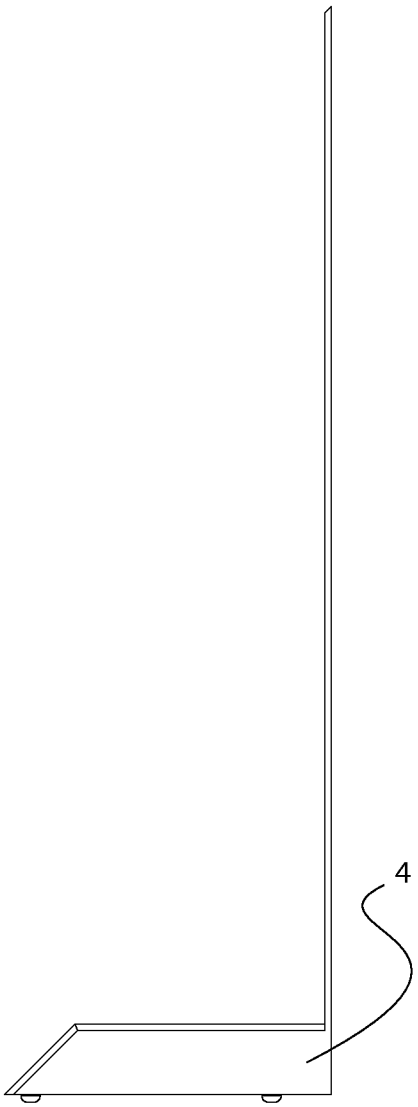
FIG. 7 is a side view of the first embodiment charging component of the present invention.
Figure 8:
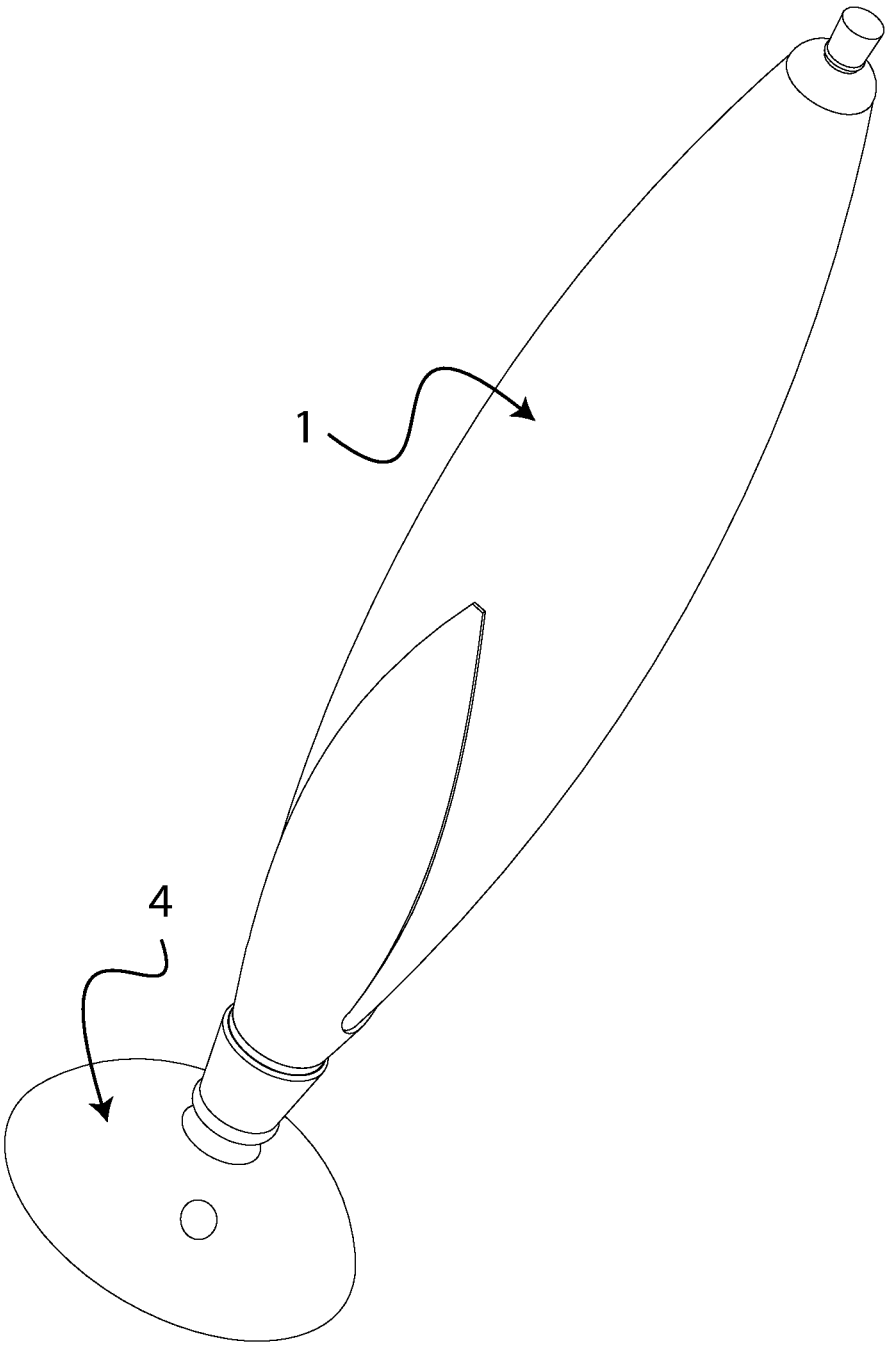
FIG. 8 is a perspective view of the handle component and a second embodiment charging component of the present invention.
Figure 9:
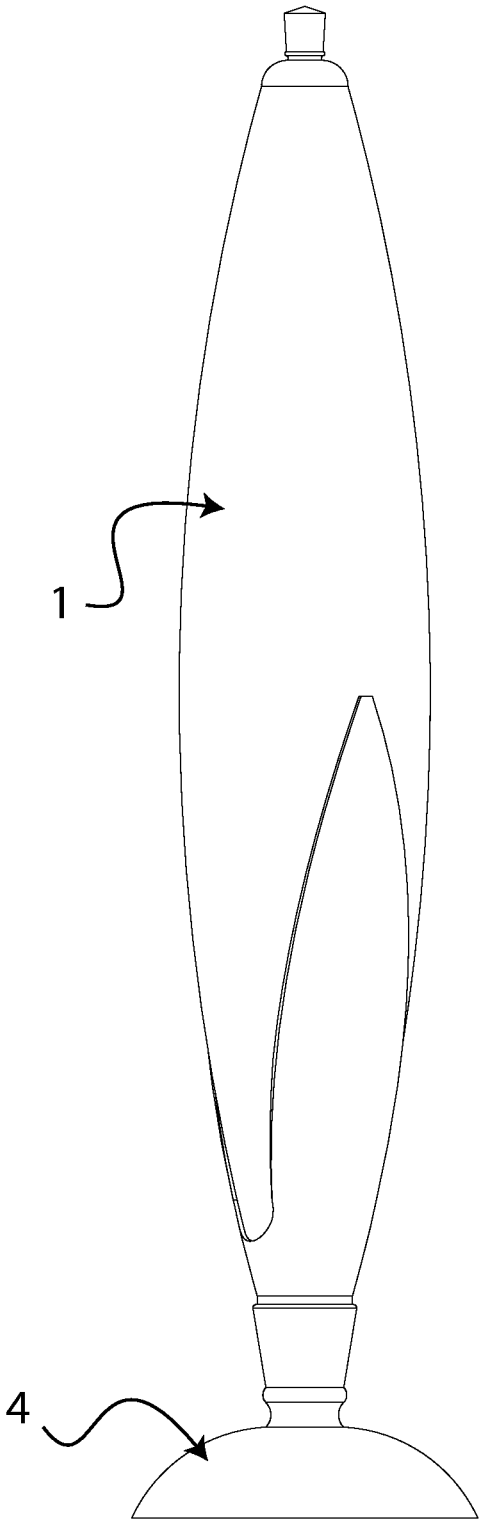
FIG. 9 is a side view of the handle component and the second embodiment charging component of the present invention.
Figure 10:
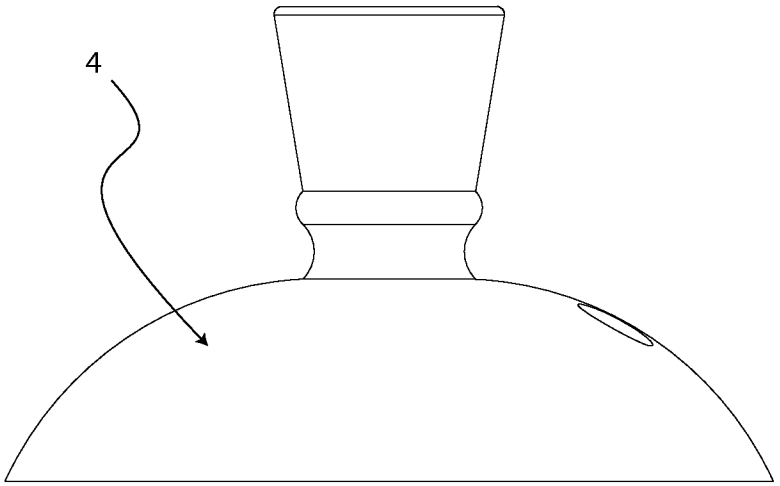
FIG. 10 is a side view of the second embodiment charging component of the present invention.
Figure 11:
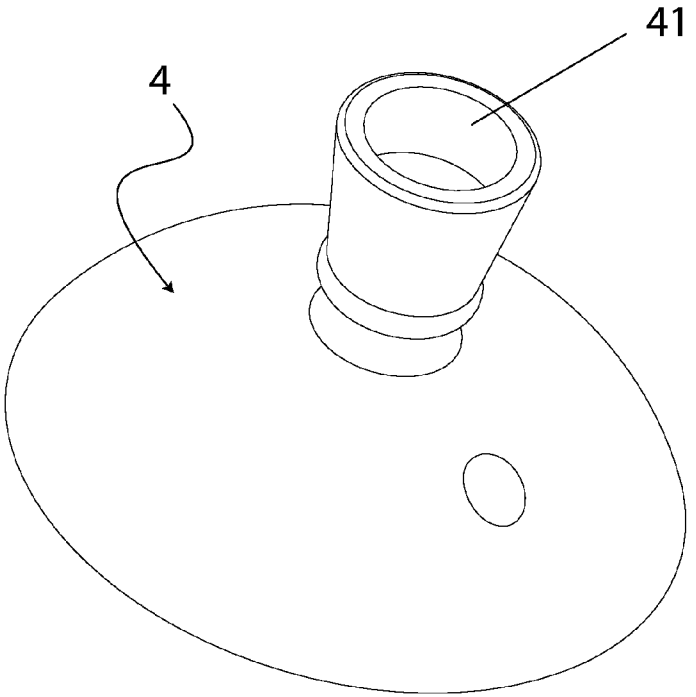
FIG. 11 is a perspective view of the second embodiment charging component of the present invention.
Figure 12:
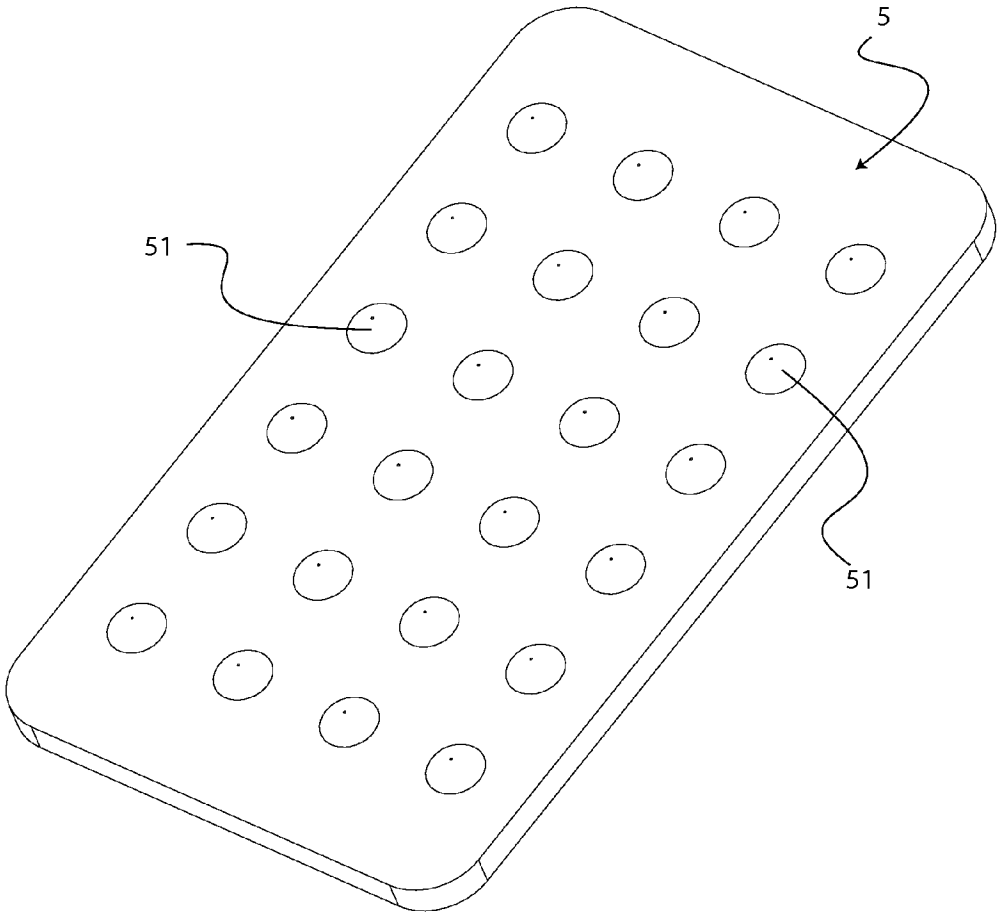
FIG. 12 is a perspective view of the remote control unit in the present invention.

The charging station 4 comprises a connecting hole 41 and is designed into two different embodiments. As show in FIG. 5, the bottom connector 14 of the handle casing 1 is inserted into the connecting hole 41 of a first embodiment. The first embodiment is connected to the battery 3 from the bottom side of the handle casing 1 so the LED light strip 2 can be powered or the battery 3 can be recharged. The first embodiment is designed as a bigger charging station 4 compare to the second embodiment. The first embodiment comprises a steady platform for added stability of the present invention. As shown in FIG. 8 and FIG. 9, the bottom connector 14 of the handle casing 1 is inserted into the connecting hole 41 of a second embodiment. The second embodiment is connected to the battery 3 from the bottom side of the handle casing 1 so the LED light strip 2 can be powered or the battery 3 can be recharged. The second embodiment is designed as a smaller charging station 4. The first and second embodiments perform as induction charging stations 4. Through the use of an induction charging system, the present invention has eliminated the need for contact points within the system. The induction charging station 4 allows the unit to last a longer time period as there is less chance for damage to the handle casing 1 or the charging station 4. Both embodiments of the charging stations 4 have been designed to be functional when charging the handles overnight. The first and second embodiments also comprise an aesthetically pleasing look for proper display purposes. The charging station 4 is connected with an external power outlet with an extension cord so the charging station 4 is able to distribute the power to the present invention.

The different brands and the handle casings 1 are interchangeable as needed. The transparent part of the handle is the logo so that the lights can shine through and create the illuminated effect. The branded handle casing 1 can be manufactured to meet the purchasers' needs for design and look. Once the present invention is sold to the users (restaurants, bars, clubs, casino's, etc.), the user connects the tap handle to an already existing beer tower. All of the controls from that point on are handled by the remote control 5. By illuminating the handle, the present invention allows for the brand to stand out so the consumers do not have to ask any questions. For an example, consumers can simply walk into a bar and order what is available. If the users are temporally out of certain product, they can switch off the specific handle casing 1. The above examples illustrate the efficiency of the present invention usefulness to both consumers and the users.

The present invention is designed to fit the current models of beer towers in use today. The bottom connector 14 of the handle has a female threaded connection which connects the present invention to the beer towers already installed in restaurants in North America. According to the demand, the female threaded connection can be changed into male threaded connection also. Users can unscrew the existing tap handles and screw the present invention into the beer towers. By doing this, there is virtually no transition for the bars/restaurants to begin using the present invention. Through the production process, the present invention is manufactured to meet the demands of the users. At the end of the shift, the tap handle is un-screwed from the beer tower and placed on the charging station 4 to recharge over night with the induction charging method.

Although the invention has been explained in relation to its preferred embodiment, it is to be understood that many other possible modifications and variations can be made without departing from the spirit and scope of the invention as hereinafter claimed.

What is claimed is:

1. An illuminated tap handle comprises,
a handle casing;
a Light Emitting Diode (LED) light strip;
a battery;
a charging station;
a remote control;
the handle casing comprises a top connector, a transparent face, a holder, and a bottom connector;
the battery being positioned inside the handle casing;
the handle casing being inserted into the charging station;
the LED light strip being remotely controlled by the remote control; and
the LED light strip being positioned inside the handle casing.

2. The illuminated tap handle as claimed in claim 1 comprises,
the top connector being connected to the transparent face;
the transparent face being inserted into the holder; and
the holder being connected to the bottom connector.

3. The illuminated tap handle as claimed in claim 1 comprises,
the LED light strip being positioned above the battery;
the LED light strip being electronically connected to the battery;
the battery being positioned above the bottom connector; and
the battery being connected to the bottom connector.

4. The illuminated tap handle as claimed in claim 3 comprises,
the LED light strip comprises a plurality of LED lights; and
the plurality of LED lights being electronically connected along the LED light strip.

5. The illuminated tap handle as claimed in claim 1 comprises,
the charging station comprises a connecting hole;
the connecting hole being centrally positioned in the charging station; and
the bottom connector being concentrically inserted into the connecting hole.

6. The illuminated tap handle as claimed in claim 1 comprises,
the remote control comprises a plurality of buttons;
the remote control comprises a plurality of buttons; and
the plurality of buttons are connected to the remote control.

7. An illuminated tap handle comprises,
a handle casing;
a Light Emitting Diode (LED) light strip;
a battery;
a charging station;
a remote control;
the handle casing comprises a top connector, a transparent face, a holder, and a bottom connector;
the LED light strip being positioned inside the handle casing;
the battery being positioned inside the handle casing;
the handle casing being inserted into the charging station; and
the LED light strip being remotely controlled by the remote control.

8. The illuminated tap handle as claimed in claim 7 comprises,
the top connector being connected to the transparent face;
the transparent face being inserted into the holder; and
the holder being connected to the bottom connector.

9. The illuminated tap handle as claimed in claim 7 comprises,
the LED light strip being positioned above the battery;
the LED light strip being electronically connected to the battery;

the battery being positioned above the bottom connector; and the battery being connected to the bottom connector.

10. The illuminated tap handle as claimed in claim 9 comprises, the LED light strip comprises a plurality of LED lights; and the plurality of LED lights being electronically connected along the LED light strip.

11. The illuminated tap handle as claimed in claim 7 comprises, the charging station comprises a connecting hole;

the connecting hole being centrally positioned in the charging station; and the bottom connector being concentrically inserted into the connecting hole.

12. The illuminated tap handle as claimed in claim 7 comprises, the remote control comprises a plurality of buttons;

the remote control comprises a plurality of buttons; and the plurality of buttons are connected to the remote control.

13. An illuminated tap handle comprises, a handle casing;

a Light Emitting Diode (LED) light strip;

a battery;

a charging station;

a remote control;

the handle casing comprises a top connector, a transparent face, a holder, and a bottom connector;

the LED light strip being positioned inside the handle casing;

the battery being positioned inside the handle casing;

the handle casing being inserted into the charging station; and the LED light strip being remotely controlled by the remote control.

14. The illuminated tap handle as claimed in claim 13 comprises, the top connector being connected to the transparent face;

the transparent face being inserted into the holder; and the holder being connected to the bottom connector.

15. The illuminated tap handle as claimed in claim 13 comprises, the LED light strip being positioned above the battery;

the LED light strip being electronically connected to the battery;

the battery being positioned above the bottom connector;

the battery being connected to the bottom connector;

the LED light strip comprises a plurality of LED lights; and the plurality of LED lights being electronically connected along the LED light strip.

16. The illuminated tap handle as claimed in claim 13 comprises, the charging station comprises a connecting hole;

the connecting hole being centrally positioned in the charging station; and the bottom connector being concentrically inserted into the connecting hole.

17. The illuminated tap handle as claimed in claim 13 comprises, the remote control comprises a plurality of buttons;

the remote control comprises a plurality of buttons; and the plurality of buttons are connected to the remote control.

* * * * *